United States Patent [19]

Holden

[11] 4,081,887

[45] Apr. 4, 1978

[54] PRODUCTION OF BULKY, CONTINUOUS FILAMENT YARN

[75] Inventor: Gordon Alan Holden, Vine Acre, Wales

[73] Assignee: Crimpfil Limited, Aberbargoed, Bargoed, Wales

[21] Appl. No.: 751,408

[22] Filed: Dec. 16, 1976

Related U.S. Application Data

[63] Continuation-in-part of Ser. No. 541,355, Jan. 15, 1975, Pat. No. 4,000,551.

[51] Int. Cl.[2] ..... D02G 1/16

[52] U.S. Cl. ..... 28/271; 28/281

[58] Field of Search ..... 28/1.4, 72 HR, 72.12, 28/75 W, 271, 272, 281, 268, 286; 57/34 B, 140 BY, 157 F; 428/364

[56] References Cited

U.S. PATENT DOCUMENTS

| | | | |
|---|---|---|---|
| 2,962,794 | 12/1960 | Field | 28/72.12 |
| 2,979,883 | 4/1961 | Waltz | 28/72.12 |
| 3,388,444 | 6/1968 | Benson | 28/72.12 |
| 3,892,020 | 7/1975 | Koslowski | 28/72.12 |
| 3,940,917 | 3/1976 | Strachan | 28/72.12 X |

FOREIGN PATENT DOCUMENTS

| | | | |
|---|---|---|---|
| 673,077 | 10/1963 | Canada | 28/271 |

*Primary Examiner*—Louis K. Rimrodt
*Attorney, Agent, or Firm*—Blanchard, Flynn, Thiel, Boutell & Tanis

[57] ABSTRACT

A method of producing a bulky continuous filament yarn which includes the steps of feeding primary and secondary continuous multi-filament polymeric yarns into a treatment zone within an air nozzle device, with one of the yarns being pre-treated by the application of water so that said one yarn is wet when fed into the treatment zone. The yarns in the treatment zone are subjected to a turbulent fluid flow which causes the individual filaments of the yarns to separate, and also causes ring-like loops to be formed at randomly spaced intervals along the individual filaments of the secondary yarn. The filaments of the yarns become intermingled within the treatment zone and are withdrawn and collected in the form of a single yarn. The primary yarn is fed into the treatment zone at a rate between 4 and 26% greater than the rate at which the intermingled filaments are withdrawn from the treatment zone, and the secondary yarn is fed into the treatment zone at a rate which is at least 2.5% greater than the rate of feed of the primary yarn and up to 30% greater than the rate at which the intermingled fibres are withdrawn from the treatment zone.

13 Claims, 8 Drawing Figures

FIG. 1.
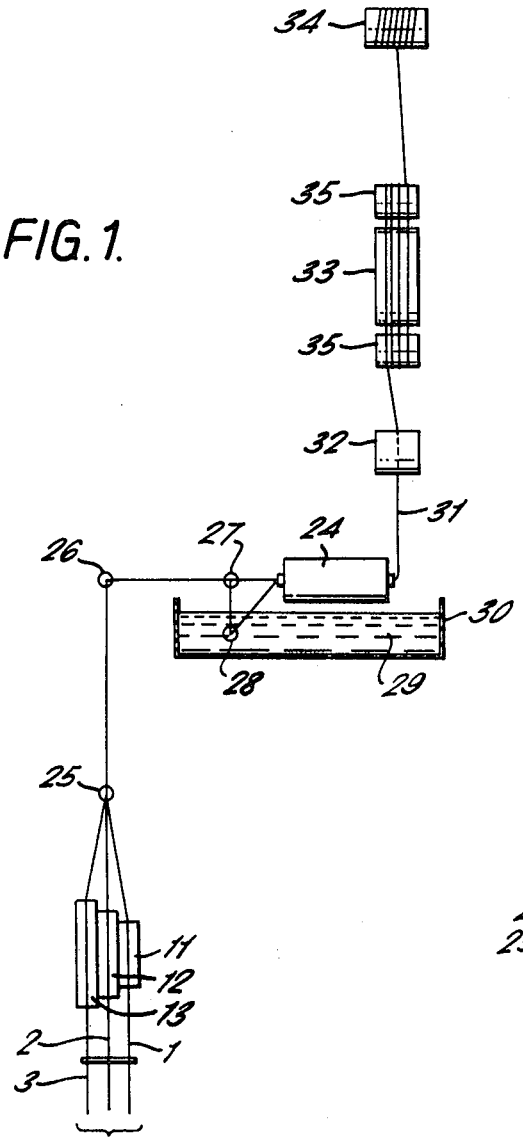
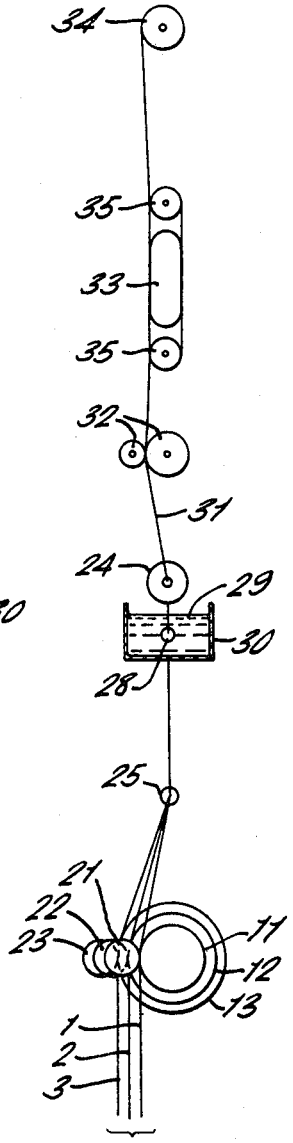
FIG. 2.

LOW OVERFEED FIG. 4.
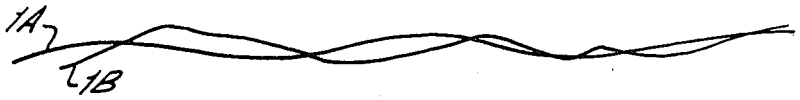
INTERMEDIATE OVERFEED FIG. 5.
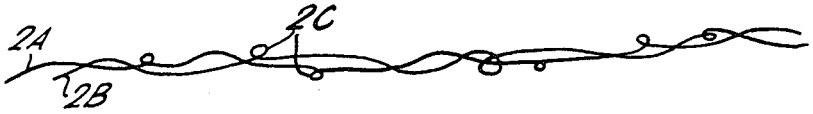
HIGHEST OVERFEED FIG. 6.
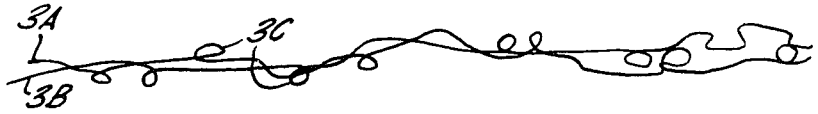
COMPOSITE YARN FIG. 3.
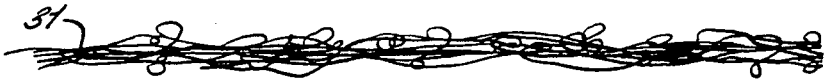

PRODUCTION OF BULKY, CONTINUOUS FILAMENT YARN

CROSS REFERENCE TO RELATED APPLICATION

This is a continuation-in-part of application Ser. No. 541,355 filed Jan. 15, 1975, now U.S. Pat. No. 4,000,551.

BACKGROUND OF THE INVENTION

The invention relates to the production of bulky, continuous filament yarn.

United Kingdom Pat. Specification No. 732,929 describes and claims a bulky, continuous filament yarn and a method and apparatus for its manufacture in which a multi-filament flat yarn is subjected to the action of a fluid stream in a zone of sufficient turbulence to separate the individual filaments and to form them into ring-like, crunodal loops and other convolutions. To accommodate the formation of these loops and other convolutions, the yarn is fed into the turbulence zone at a greater speed than it is withdrawn.

Whilst the resultant bulky yarn is suitable for the production of fabrics for some end uses, it does not have sufficient bulk for fabrics of some other end uses. For example boucle type yarns suitable for the production of upholstery fabrics cannot be produced by subjecting a single end of yarn to turbulence. In practice, fabrics produced by subjecting a single yarn end to turbulence are subject to pluckiness and lack of stability.

It has therefore been proposed, in United Kingdom Pat. Specification No. 893,020, to produce core and effect yarns in which a yarn providing the core filaments of the core and effect yarn are fed into a zone of fluid turbulence at a much lower speed than each of the filaments providing the loops and other convolutions necessary in highly bulked fancy yarn. However, although these core and effect yarns are suitable for the production of upholstery fabrics, they are not suitable for knitted or woven apparel fabrics.

SUMMARY OF THE INVENTION

It is therefore an object of the present invention to provide a continuous filament yarn having improved bulkiness, stability and covering power hitherto unattainable by known methods of production.

According to the invention, there is provided a method of producing a bulky, continuous filament yarn including the steps of feeding primary and secondary continuous multi-filament yarns comprising, respectively, at least 20% and up to 80% of the total filaments into a treatment zone; providing within the treatment zone a fluid flow of sufficient turbulence to separate the individual filaments of the yarns, to form crunodal, ring-like loops and other convolutions at randomly spaced intervals along the lengths of the individual filaments of each secondary yarn and to cause the indivdual filaments of each secondary yarn to intermingle with each other and with the individual filaments of each primary yarn; wetting one of the yarns prior to feeding it into the treatment zone; and withdrawing the intermingled filaments from the treatment zone and collecting the intermingled filaments in the form of a single yarn; each primary yarn being fed into the treatment zone at a rate between 4 and 26% higher than the rate at which the intermingled filaments are withdrawn from the treatment zone and each secondary yarn being fed into the treatment zone at a rate which is at least 2.5% higher than the rate of feed of each primary yarn and up to 30% higher than the rate at which the intermingled filaments are withdrawn from the turbulent zone.

A preferred embodiment of the invention includes the steps of pre-treating at least one primary continuous multi-filament yarn by the application of an aqueous liquid and feeding primary and secondary continuous multi-filament yarns of polymeric material comprising said pre-treated yarn and at least one secondary yarn so that each yarn to which aqueous liquid has been applied enters the treatment zone while still wet.

Thus, the present invention also provides a method of producing bulky, continuous filament yarn of polymeric material in which at least 20% of the filaments are substantially straight and the remainder of the filaments are formed at randomly spaced longitudinal intervals with crunodal, ring-like loops and other convolutions separated by relatively straight portions and are intermingled with each other and with the substantially straight filaments so that, when a gradually increasing tensile load is imposed on the bulky yarn, all the filaments break simultaneously, the method comprising the steps of pre-treating at least one primary continuous multi-filament yarn of polymeric material by the application of an aqueous liquid; feeding primary and second continuous multi-filament yarns of polymeric material comprising said pre-treated primary yarn and at least one secondary yarn and respectively providing at least 20% and the remainder of up to 80% of the total filaments into a treatment zone within an air nozzle device so that each yarn to which the liquid has been applied enters the treatment zone while still wet; providing within the treatment zone a fluid flow of sufficient turbulence to separate the individual filaments of the yarns, to form crunodal, ring-like loops and other convolutions at randomly spaced intervals along the lengths of the individual filaments of each secondary yarn while the filaments of each primary yarn remain substantially straight and free from crunodal, ring-like loops and to cause the individual filaments of each secondary yarn to intermingle with each other and with the substantially straight individual filaments of each primary yarn; withdrawing the intermingled filaments from the treatment zone and collecting the intermingled filaments in the form of a single bulky yarn, each primary yarn being fed into the treatment zone at a rate between 4 and 26% higher than the rate at which the intermingled filaments of the bulky yarn are withdrawn from the treatment zone and each secondary yarn being fed into the treatment zone at a rate which is at least 2.5% higher than the rate of feed of each primary yarn and up to 30% higher than the rate with which the bulky yarn is withdrawn from the treatment zone.

A sufficiently turbulent fluid flow is provided in the treatment zone by means of a conventional air nozzle provided for this purpose, for example; as described in United Kingdom Patent Specification No. 732,929. In passing into the nozzle, the yarns are blown about and whipped violently so that the individual filaments are first separated and then the filaments of each secondary yarn are swirled into crunodal, ring-like loops and other convolutions which interlock with the other filaments. When the resultant bulky yarn is subjected to a gradually increasing tensile load, this inter-locking ensures that part of the load is borne by the filaments of the or each secondary yarn.

Although it is clear that the pre-treatment of at least one primary yarn with an aqueous liquid results in a bulky yarn in which the primary and secondary yarns are more effectively intermingled, it is not entirely clear how this improvement is brought about. However, it is believed that the liquid has a two-fold effect. Firstly, gas turbulence within the treatment zone forms the liquid into a spray which is more effective than the turbulent gas in forming crunodal loops and other convolutions in the filaments of the or each secondary yarn and, secondly, the liquid acts as a lubricant which facilitates the intermingling of the crunodal loops and other convolutions of the filaments of the or each secondary yarn with the filaments of the or each primary yarn. It has been found that the overall effect of the liquid in providing an improved bulky yarn is increased if the aqueous liquid is applied to at least one primary yarn rather than to at least one secondary yarn.

In the production of this bulky yarn, by a method according to the present invention, the primary and secondary yarns may be passed through at least two separate feeding means which are operable to feed the yarns at different speeds. However, where different yarns are to be fed at the same speed, it is not necessary to provide separate feeding means for each such yarn; they can be passed through the same feeding means. Feeding means, downstream of the treatment zone, may then be provided in order to collect the bulky yarn at a further, lower speed.

As a consequence of the difference in over-feeds which are applied to the constituent yarns, the individual filaments of the bulky yarn are subjected to various degrees of strain during the bulking process. As a result, when the bulky yarn is subjected to shrinkage, as by the application of heat, two phenomena are observed; firstly, the tighter filaments of each primary yarn have a tendency to contract and create greater bulk in the yarn and, secondly, the loops of the filaments of each secondary yarn which appear on the surface of the bulky yarn have a tendency to be pulled back into the main body of the bulky yarn, thereby reducing pickiness or pluckiness of the yarn.

The foregoing unique properties can be used to advantage to obtain still further improvement in bulkiness and reduced pickiness of the bulky yarn. This is achieved by subjecting the bulky yarn to a heat relaxing process, either as a separate operation or, preferably, as a step in the method of producing the bulky yarn.

To achieve maximum shrinkage with a synthetic yarn, it is preferable to use a contact heater or, alternatively, a tube heater which heats the yarn by a combination of both convection and conduction.

The bulky yarn formed from the intermingled filaments is fed on to or through the heater in a relaxed condition to achieve a shrinkage which is equivalent or somewhat in excess of the potential boiling water shrinkage for most synthetic yarns; this shrinkage is approximately 10%.

The yarn is therefore overfed into the heater to achieve a tension low enough to ensure that full shrinkage can take place. Many forms of heater are available, but the preferred type comprises a multi-path contact heater of approximately one meter in length which is totally enclosed to increase its efficiency. The yarn is fed upwards to the top of the heater, around a roller and back through the heater, around a further roller disposed below the heater and then upwards through the heater once again. After several passes around the upper and lower rollers, the yarn is fed up to a take-up package. It is also possible to improve bulking and loop retraction in separate operations subsequent to the preparation of the bulky yarn. With knitwear, this can be done by subjecting garments to high pressure steaming at 130° C.

The heat shrinkage obtained gives improved stability during finishing and, since potential shrinkage has been decreased, fabric formed from the bulky yarn will not have the same tendency to crease during finishing of the fabric. The development of longitudinal creases in fabric is a well-known phenomenon and could cause considerable trouble during normal fabric finishing. The further reduction in pickiness of the yarn also reduces the yarn to yarn friction within the fabric and this will improve the recovery from extension and will reduce the amount of creasing developed in the fabric during normal use.

The intermingled filaments withdrawn from the treatment zone, where they are subjected to turbulent fluid flow, are eventually collected on a wind-up device, for example; a down-twister or cheese-winder and, in order to ensure that the bulky yarn is wound at an appropriate tension, it may be passed through a pair of take-up rolls which, together with the wind-up device, ensure that the bulky yarn is fed to the wind-up device with a suitable under-feed, typically between 5 and 10%.

The method according to the present invention is particularly suitable for the production of bulky yarns from continuous filament yarns of polyester and polyamide. However, continuous filament yarns of other polymeric material can also be used, for example: polyolefin yarns, viscose rayon yarns and cellulose acetate yarns. Variations in texture and bulk may be obtained by using constituent yarns of different materials, by using constituent yarns of different structures and by varying the relative rate of overfeed of the different constituent yarns through the treatment zone.

It has been found that by using different over-feeds for different constituent yarns passed through the treatment zone and limiting the overfeeds to 30%, bulky yarns may be produced at a much higher speed than if all the constituent yarns were fed through the treatment zone at the same speed. This therefore gives rise to greater economies in production and creates yarns which can be produced at speeds more economically than hitherto known.

The relative overfeeds of the constituent yarns will depend on the denier of the final yarn, the denier of the constituent yarns and also on the filament denier of the constituent yarns and should be maintained within 1%. It has been found by experiment, that the relative overfeeds are extremely critical and a change in filament denier or any other characteristic of the constituent yarns requires a modification of the relative overfeeds to produce a yarn which has acceptable bulk and is reasonably free from pluckiness when made into a woven or knitted fabric.

The interlocking of the filaments of the bulky yarn provides greater stability than has hitherto been attainable. This not only improves the pilling properties of fabrics made from the yarn, but improves the efficiency of subsequent processing, particularly where the yarn is used as warp in a woven fabric. The resistance to abrasion brought about by the improved interlocking of the filaments also enables the yarns to be woven without size.

Five bulky, continuous filament yarns, and their methods of manufacture according to the invention, are hereinafter described by way of example, with reference to the accompanying drawings, in which:

DESCRIPTION OF THE DRAWINGS

FIGS. 1 and 2 are schematic side and front elevations of apparatus for performing a method of producing a bulky, continuous filament yarn, according to the invention;

FIG. 3 is an enlarged elevational view of the bulky yarn provided by the method described with reference to FIGS. 1 and 2;

FIGS. 4 to 6 are schematic elevational views of two filaments from each of three multi-filament components of the bulky yarns shown in FIG. 3.

DESCRIPTION OF PREFERRED EMBODIMENTS

Figure 7:
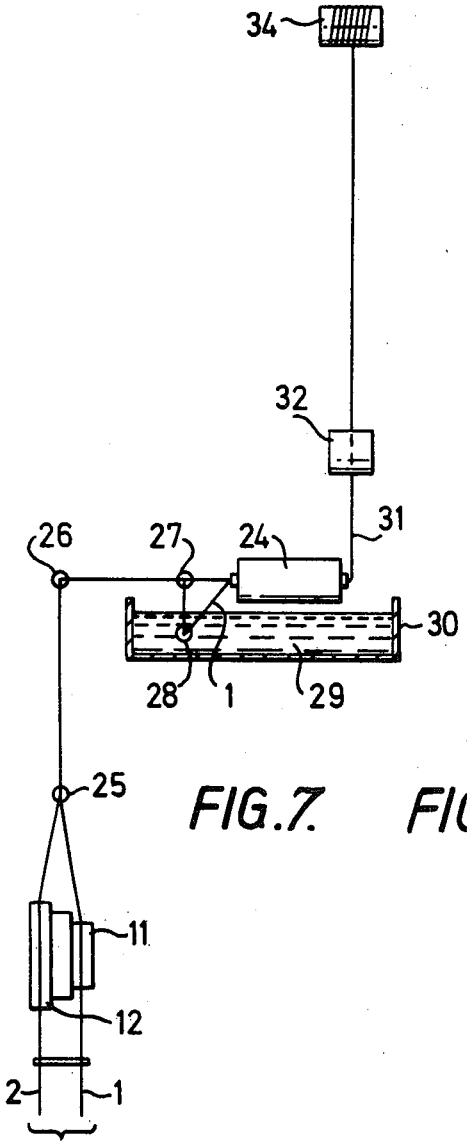
FIGS. 7 and 8 are schematic side and front elevations of a modified form of the apparatus shown in FIGS. 1 and 2 for producing a bulky, continuous filament yarn from two constituent yarns of polymeric material.

As shown in FIGS. 1 and 2, a 167 decitex 72 filament primary yarn 1 of polyester and two secondary yarns 2 and 3 comprising, respectively, a 78 decitex 20 filament yarn of polyhexamethylene adipamide (sold under the trade name nylon) and a 167 decitex 72 filament polyester yarn are fed over axially spaced portions 11, 12 and 13 of a stepped feed roll and held in driving engagement with the feed roll by three pressure rollers 21, 22 and 23 (FIG. 2) to form three separate pairs of feed rolls. The rotational speed of the feed roll and the diameters of the portions 11, 12 and 13 of the feed roll are such that the primary yarn 1 and the two secondary yarns 2 and 3 passing through the three separate pairs of feed rolls are withdrawn from creels (not shown) at rates of 336, 345 and 363 meters per minute. The three yarns 1, 2 and 3 withdrawn from the creels are fed into a treatment zone in a conventional air nozzle device through yarn guides 25, 26 and 27. However, the 167 decitex 72 filament secondary yarn 3 is pre-treated before entering into the nozzle device 24 by being passed through a yarn guide 28 immersed in water 29 in a pan 30 and is fed into the treatment zone along a path which is inclined to the path of the yarn through the treatment zone, whereas the other two yarns 1 and 2 are fed into the treatment zone along a path which is colinearly aligned with the rectilinear path of the yarn and the treatment zone. Inside the air nozzle device 24, the wet yarn 3 and the yarns 1 and 2 pass through the treatment zone where turbulent air flow causes the filaments of the different yarns to intermingle so as to form a single composite bulky yarn 31 which passes between a pair of cylindrical feed rolls 32 having a rotary speed sufficient to withdraw the bulky yarn 31 from the nozzle device 24 at a rate of 300 meters per minute. The yarns 1, 2 and 3 are thus fed into the treatment zone within the nozzle device 24 at rates of 36, 45 and 63 meters per minute higher than the 300 meters per minute the bulky yarn 31 is withdrawn. As a result of these overfeeds of 12, 15and 21%, there is considerable slack in the filaments of the three yarns as they pass through the treatment zone. The filaments of the primary yarn are therefore separated from each other and the filaments of the secondary yarns are blown about and whipped violently in such manner that the individual filaments are first separated and then swirled into crunodal, ring-like loops and other convolutions which interlock the filaments of the two secondary yarns and also interlock these filaments with the filaments of the primary yarn which are separated by the turbulence, but not themselves formed with convolutions.

After formation of the composite, bulky yarn 31, it is fed over a contact heater 33 to a take-up mandrel 34 to effect relaxation of stress induced in the filaments by the turbulence within the treatment zone. As shown in FIGS. 1 and 2, the yarn 31 is trained around rollers 35 and is passed several times around the contact heater 33, which is heated to a temperature of about 220° C, where it is heated by convection and conduction. To accommodate a 10% shrinkage of the yarn 31 during the heat relaxation operation, the yarn 31 is passed over the contact heater 33 with a 15% overfeed so that, although the yarn 31 is fed to the contact heater 33 at a rate 300 meters per minute, it is withdrawn at a rate of 255 meters per minute.

The yarn 31 is then passed from the contact heater 33 to the take-up mandrel 34 with sufficient underfeed to remove the slack in the yarn 31. Thus, with an underfeed of 5.9%, the yarn 31 withdrawn from the contact heater 33 at a rate of 255 meters per minute is wound onto the take-up mandrel 34 at a rate of 270 meters per minute so as to allow for the 10% shrinkage of the yarn 31 fed over the contact heater 33.

The bulky yarn 31 produced by this method has the appearance illustrated in FIG. 3.

As shown in FIG. 4, filaments 1A and 1B representing two of the 72 filaments of the primary yarn are separated from each other so as to permit the insertion of convolutions formed in the filaments of the two secondary yarns, but are not themselves formed with crunodal, ring-like loops. The filaments 2A and 2B shown in FIG. 5 and the filaments 3A and 3B shown in FIG. 6 represent, respectively, two of the 20 filaments and two of the 72 filaments of the two secondary yarns and show the formation of randomly spaced crunodal, ring-like loops 2C formed in the filaments 2A and 2B being separated by longer lengths of substantially straight filament than the loops 3C formed in the filaments 3A and 3B. After formation of the loops shown in FIGS. 5 and 6, these loops interlock the filaments of the two secondary yarns with each other and with the filaments of the primary yarn. Thus, when a gradually increased tensile load is applied to the yarn 31 the loops are prevented from collapsing and so the load is borne by all of the filaments and, on further increase in tensile loading, all of the filaments break substantially simultaneously. The primary yarn 1 provides 72 of the 164 filaments of the bulky yarn 31, that is to say: approximately 44% of the filaments of the bulky yarn.

In a second example of the method of forming bulky yarn, according to the present invention, a 150 denier 48 filament primary yarn of polyester and three secondary yarns respectively comprising two 100 denier 34 filament polyamide yarns and a further 150 denier 48 filament polyester yarn are fed through the apparatus illustrated in FIGS. 1 and 2 so that the yarns are passed through a zone of turbulence by means of the three separate pairs of feed rolls and a single pair of withdrawal rolls so that the primary yarn is given an 8% overfeed, two secondary yarns of polyamide are given an overfeed of 18% and the secondary yarn of polyester is given an overfeed of 24%. Thus, for a withdrawal rate of 300 meters per minute, the primary yarn is fed into the treatment zone at a first rate of 324 meters per minute and the secondary yarns are fed at rates of 354, 354 and 372 meters per minute. The composite yarn resulting from this combination has 164 filaments which are so intermingled as to provide a bulky texture. The 48 filaments (more than 29% of the total) of the primary yarn are relatively free of crunodal, ring-like loops, but the remaining filaments are formed with crunodal, ring-like loops and other convolutions and are interlocked with each other and with the 48 filaments of the primary yarn.

Figure 8:
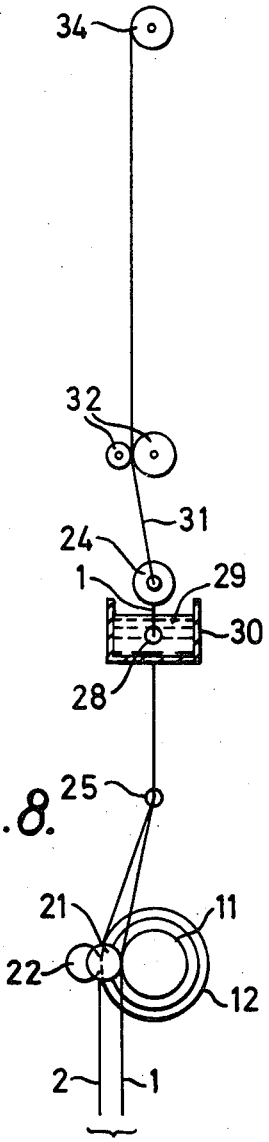

In the apparatus shown in FIGS. 7 and 8, a 167 decitex 68 filament primary yarn 1 of polyester and a 167 decitex 68 filament secondary yarn 2 of polyester are fed over axially spaced portions 11 and 12 of a stepped feed roll and held in driving engagement with the feed roll by two pressure rollers 21 and 22 (FIG. 8) which, together with the stepped feed roll, form two separate pairs of feed rolls. The rotational speed of the stepped feed roll and the diameters of the portions 11 and 12 of the feed roll are such that the primary yarn 1 and the secondary yarn 2 passing through the two separate pairs of feed rolls are withdrawn from creels (not shown) at rates of 547 and 582 meters per minute. The two yarns 1 and 2 withdrawn from the creels are fed to the conventional air nozzle device 24 through yarn guides 25, 26 and 27. However, the 167 decitex 68 filament primary yarn 1 is pre-treated before entering into the nozzle device 24 by being passed through a yarn guide 28 immersed in water 29 in a pan 30. The wet primary yarn 1 and the secondary yarn 2 then pass axially through the air nozzle device 24 along a rectilinear path through the treatment zone (not shown) inside the nozzle device 24 in which a turbulent air flow causes the filaments of the different yarns to intermingle so as to form a single bulky yarn 31 which passes between a pair of cylindrical feed rolls 32 having a rotary speed sufficient to withdraw the bulky yarn 31 from the nozzle device 24 at a rate of 461 meters per minute. The yarns 1 and 2 are thus fed into the treatment zone within the nozzle device 24 at rates of 86 and 121 meters per minute higher than the 461 meters per minute the bulky yarn 31 is withdrawn. As a result of these overfeeds of 18.7% and 26.2% there is considerable slack in the filaments of the two yarns as they pass through the treatment zone. The filaments of the primary yarn are therefore separated from each other and the filaments of the secondary yarns are blown about and whipped violently in such manner that the individual filaments are first separated and then swirled into crunodal, ring-like loops and other convolutions which interlock the filaments of the secondary yarn and also interlock these filaments with the filaments of the primary yarn which are separated by the turbulence, but not themselves formed with convolutions.

The bulky yarn is then wound into a package on a take-up mandrel 34 at the rate of 500 meters per second.

With a method such as this the input titre of the constituent yarns is 334 decitex and the final titre of the bulky yarn is 378 decitex. Although not shown, it is also possible to subject the composite bulky yarn issuing from the air nozzle device 24 to heat treatment as described with reference to the apparatus illustrated in FIGS. 1 and 2.

The bulky yarn 31 produced by this method has an appearance which is similar to that schematically illustrated in FIG. 3.

As shown in FIG. 4, filaments 1A and 1B representing two of the 68 filaments of the primary yarn 1 are separated from each other so as to permit the insertion of convolutions formed in the filaments of the secondary yarn 2, but are not themselves formed with crunodal, ring-like loops. The filaments 2A shown in FIG. 5 represent two of the 68 filaments of the secondary yarn 2 and show the formation of randomly spaced crunodal, ring-like loops 2C along the lengths of the filaments. After formation of the loops shown in FIG. 5, these loops interlock the filaments of the secondary yarn 2 with each other and with the filaments of the primary yarn 1. Thus, when a gradually increased tensile load is applied to the resultant bulky yarn 31, the loops are prevented from collapsing and so the load is borne by all of the filaments and, on further increase in tensile loading, all of the filaments break substantially simultaneously. The primary yarn 1 and the secondary yarn 2 both provide 68 of the 136 filaments of the bulky yarn 31, that is to say 50% of the filaments of the bulky yarn.

In a fourth example of the method of forming bulky yarn, according to the present invention, by means of the apparatus illustrated in FIGS. 7 and 8, an additional 78 decitex 20 filament primary yarn of nylon is fed through the apparatus illustrated in FIGS. 7 and 8 so that the two primary yarns are given an 15.4% overfeed and the secondary yarn of polyester is given an overfeed of 20.6%. Thus, for a withdrawal rate of 460 meters per minute, the primary yarns are fed into the treatment zone at a rate of 531 meters per minute and the secondary yarn is fed at a rate of 555 meters per minute. The bulky yarn resulting from this combination has 156 filaments which are so intermingled as to provide a bulky texture. The 88 filaments (more than 56% of the total) of the primary yarns are relatively free of crunodal, ring-like loops, but the remaining filaments are formed with crunodal, ring-like loops and other convolutions and are interlocked with each other and with the 88 filaments of the primary yarns.

After withdrawing the bulky yarn from the treatment zone at a rate of 460 meters per minute, it is then wound into a package on the take-up mandrel at a rate of 485 meters per minute. The titre of the constitutent yarns is thus increased from 412 decitex to 461 decitex.

In a fifth example of the method of forming bulky yarn, according to the present invention, two 78 decitex 34 filament primary yarns of nylon are fed through the apparatus illustrated in FIGS. 7 and 8 together with two secondary yarns respectively comprising a 220 decitex 52 filament triacetate yarn and a 78 decitex 34 filament nylon yarn. In this case the feed rates of the primary and secondary yarns and the package take-up rate are the same as in the third example and the titre of the constituent yarns is increased from 454 to 518 decitex.

In each of the third, fourth and fifth examples, only one primary yarn is subjected to pre-treatment with water. However, in each case, it is also possible to pre-treat at least one secondary yarn. Similarly, in the fourth and fifth examples, it is possible to pre-treat more than one primary yarn with water.

Having described my invention, I claim:

1. A method of producing bulky, continuous filament yarn in which a primary continuous multi-filament yarn of polymeric material comprising at least 20% of the total filaments and having filaments which are substantially straight and free from crunodal ring-like loops and a secondary continuous multi-filament yarn of polymeric material comprising up to 80% of the total filaments and having filaments which are formed at randomly spaced longitudinal intervals with crunodal ring-like loops separated by relatively straight portions and are intermingled with each other and with the substantially straight filaments of the primary yarn so that, when a gradually increasing tensile load is imposed on the bulky yarn, the filaments of both the primary and secondary yarns break simultaneously; the method including the steps of:

pre-treating at least one of the primary and secondary continuous multi-filament yarns by the application of an aqueous liquid;

feeding the primary and secondary yarns into a treatment zone so that each yarn to which the aqueous liquid has been applied enters the treatment zone while still wet;

providing within the treatment zone a fluid flow of sufficient turbulence to separate the individual filaments of the yarns, to form crunodal ring-like loops and other convolutions at randomly spaced intervals along the lengths of the individual filaments of each secondary yarn, and to cause the individual filaments of each secondary yarn to intermingle with each other and with the individual filaments of each primary yarn to form a single bulky yarn;

withdrawing the intermingled filaments from the treatment zone at a rate such that each primary yarn is fed into the treatment zone at a rate between 4% and 26% higher than the rate at which the intermingled filaments are withdrawn from the treatment zone and each secondary yarn is fed in to the treatment zone at a rate which is at least 2.5% higher than the rate of feed of each primary yarn and up to 30% higher than the rate at which the intermingled filaments are withdrawn from the treatment zone.

2. A method, according to claim 1, in which said one of the primary and secondary continuous multi-filament yarns which is pre-treated by the application of an aqueous liquid is a primary yarn.

3. A method, according to claim 1, in which the primary and secondary yarns are passed through at least two separate feeding means which feed the yarns at different speeds.

4. A method, according to claim 1, in which the intermingled filaments withdrawn from the treatment zone are fed to heating means for relaxing stresses in the filaments, prior to the collection of the intermingled filaments in the form of a single yarn.

5. A method, according to claim 4, in which the intermingled filaments are withdrawn from the heating means at a rate of up to 15% less than the rate at which the intermingled filaments are fed into the heating means so as to allow for shrinkage simultaneously with the relaxation of stresses in the filaments.

6. A method, according to claim 1, in which the aqueous liquid is water.

7. A method, according to claim 6, in which the primary yarn is a 167 decitex 72 filament polyester yarn which is fed into the treatment zone at a rate of 336 meters per minute and there are two secondary yarns comprising, respectively, one 78 decitex 20 filament yarn of hexamethylene adipamide and one 167 decitex 72 filament polyester yarn which are fed at rates of 345 and 363 meters per minute through the treatment zone and the composite yarn formed from the intermingled filaments of these yarns is withdrawn from the treatment zone at a rate of 300 meters per minute.

8. A method, according to claim 6, in which the primary yarn is a 150 denier 48 filaments polyester yarn and there are two secondary yarns comprising, respectively, two 100 denier 34 filament polyamide yarns and a 150 denier 48 filament polyester yarn, the primary yarn is fed through the treatment zone at a rate of 324 meters per minute, the two secondary yarns of polyamide are fed through the treatment zone at a rate of 354 meters per minute, the remaining, polyester secondary yarn is fed through the treatment zone at a rate of 372 meters per minute and the intermingled filaments of these yarns are withdrawn from the treatment zone at a rate of 300 meters per minute.

9. A method of producing bulky, continuous filament yarn of polymeric material in which at least 20% of the filaments are substantially straight and the remainder of the filaments are formed at randomly spaced longitudinal intervals with crunodal, ring-like loops and other convolutions separated by relatively straight portions and are intermingled with each other and with the substantially straignt filaments so that when a gradually increasing tensile load is imposed on the bulky yarn, all the filaments break simultaneously, the method comprising the steps of:

pre-treating at least one primary continuous multi-filament yarn of polymeric material by the application of an aqueous liquid;

feeding primary and secondary continuous multi-filament yarns of polymeric material comprising said pre-treated primary yarn and at least one secondary yarn and respectively providing at least 20% and the remainder of up to 80% of the total filaments into a treatment zone so that each yarn to which the liquid has been applied enters the treatment zone while still wet;

providing within the treatment zone a fluid flow of sufficient turbulence to separate the individual filaments of the yarns to form crunodal, ring-like loops and other convolutions at randomly spaced intervals along the lengths of the individual filaments of each secondary yarn while the filaments of each primary yarn remain substantially straight and free from crunodal, ring-like loops and to cause the individual filaments of each secondary yarn to intermingle with each other and with the substantially straight individual filaments of each primary yarn;

withdrawing the intermingled filaments from the treatment zone and collecting the intermingled filaments in the form of a single bulky yarn;

each primary yarn being fed into the treatment zone at a rate between 4 and 26% higher than the rate at which the intermingled filaments of the bulky yarn are withdrawn from the treatment zone and each secondary yarn being fed into the treatment zone at a rate which is at least 2.5% higher than the rate of feed of each primary yarn and up to 30% higher than the rate with which the bulky yarn is withdrawn from the treatment zone.

10. A method, according to claim 9, in which at least one additional primary yarn or at least one secondary yarn is also pre-treated by the application of an aqueous liquid.

11. A method, according to claim 9, in which one primary yarn and one secondary yarn, both 167 decitex 68 filament polyester yarns, are fed respectively into the treatment zone at a rate of 547 meters per minute and at a rate of 582 meters per minute and the bulky yarn formed from the intermingled filaments of these yarns is withdrawn from the treatment zone at a rate of 461 meters per minute.

12. A method according to claim 9, in which two primary yarns respectively comprising a 167 decitex 68 filament polyester yarn and a 78 decitex 20 filament nylon yarn, and one secondary yarn, comprising a 167 decitex 68 filament polyester yarn, are fed through the treatment zone, the primary yarns being fed through the treatment zone at a rate of 531 meters per minute, the secondary yarn being fed through the treatment zone at a rate of 555 meters per minute, and the bulky yarn formed from the intermingled filaments of these yarns is withdrawn from the treatment zone at a rate of 460 meters per minute.

13. A method according to claim 9, in which two 78 decitex 34 filament primary yarns of nylon material and two secondary yarns, respectively comprising a 220 decitex 52 filament triacetate yarn and a 78 decitex 34 filament nylon yarn, are fed through the treatment zone, the primary yarns being fed through the treatment zone at a rate of 547 meters per minute, the secondary yarns being fed through the treatment zone at a rate of 582 meters per minute, and the bulky yarn formed from the intermingled filaments of these yarns is withdrawn from the treatment zone at a rate of 461 meters per minute.

* * * * *